US007861623B2

(12) United States Patent
Miyazawa et al.

(10) Patent No.: US 7,861,623 B2
(45) Date of Patent: Jan. 4, 2011

(54) SCREW FASTENING MACHINE

(75) Inventors: Masamichi Miyazawa, Anjo (JP); Yuta Matsuura, Anjo (JP)

(73) Assignee: Makita Corporation, Anjo-Shi (JP)

( * ) Notice: Subject to any disclaimer, the term of this patent is extended or adjusted under 35 U.S.C. 154(b) by 92 days.

(21) Appl. No.: 12/292,187

(22) Filed: Nov. 13, 2008

(65) Prior Publication Data

US 2009/0126961 A1 May 21, 2009

(30) Foreign Application Priority Data

Nov. 19, 2007 (JP) ..... 2007-299539

(51) Int. Cl.
*B25B 23/00* (2006.01)
*B25B 23/157* (2006.01)

(52) U.S. Cl. ..... 81/475; 81/429

(58) Field of Classification Search ..... 81/474, 81/475, 177.4, 490, 429, 54; 408/202, 241 R, 408/241 S See application file for complete search history.

(56) References Cited

U.S. PATENT DOCUMENTS 3,779,663 A * 12/1973 Ruggles ..... 408/202
4,032,160 A * 6/1977 Karasa et al. ..... 408/241 R
5,810,525 A * 9/1998 Ector, Sr. ..... 408/241 R
7,217,069 B2 * 5/2007 Dils et al. ..... 408/241 R
2006/0090615 A1 * 5/2006 Yamada ..... 81/474

FOREIGN PATENT DOCUMENTS

JP A-2000-246657 9/2000

* cited by examiner

*Primary Examiner*—Hadi Shakeri
(74) *Attorney, Agent, or Firm*—Oliff & Berridge, PLC

(57) ABSTRACT

It is an object of the invention to provide an effective technique for preventing loss of a screw fastening depth regulating member removed from a machine body in a screw fastening machine. A representative screw fastening machine includes a machine body, a motor, an input shaft, an output shaft, a first clutch element, a second clutch element, a biasing member for first and second clutch elements, a screw fastening depth regulating member. The machine body has a holding part formed in an area other than the tip end region of the machine body to removably hold the screw fastening depth regulating member. The holding part is provided such that the screw fastening depth regulating member can be attached to and removed from the holding part by utilizing elastic deformation of the holding part.

8 Claims, 11 Drawing Sheets

SCREW FASTENING MACHINE

BACKGROUND OF THE INVENTION

1. Field of the Invention

The present invention relates to a screw fastening machine that performs a screw fastening operation by a tool bit which is rotationally driven by a motor, and more particularly to a screw fastening machine that has a function of regulating a screw fastening depth.

2. Description of the Related Art

As a representative example of a screw fastening machine, Japanese laid-open patent publication No. 2000-246657 discloses an electric screwdriver designed and configured such that a screw fastening operation is completed when a screw is driven to a predetermined depth. In the known screwdriver, a screw fastening depth regulating member for regulating the screw fastening depth is provided in the tip end region of a machine body. When a screw is driven into a workpiece to a predetermined depth in a screw fastening operation, the screw fastening depth regulating member contacts the surface of the workpiece. Therefore, the user is prevented from further moving the machine body in the screw fastening direction. Further, the force of rotationally driving the driver bit is cut off via a clutch member, so that the screw fastening operation by the driver bit is completed.

The screw fastening depth regulating member provided in the tip end region of the machine body may interfere with a screw fastening operation, for example, when the screw fastening operation is performed in a tight place. In such a case, the screw fastening depth regulating member may be removed from the machine body for the screw fastening operation. In this case, the removed screw fastening depth regulating member must be kept by the user or kept in an appropriate place within the work site. However, such has a possibility of losing the screw fastening depth regulating member. Therefore, further improvement is required in this respect.

SUMMARY OF THE INVENTION

Accordingly, it is an object of the present invention to provide an effective technique for preventing loss of a screw fastening depth regulating member removed from a machine body in a screw fastening machine.

According to the present invention, a representative screw fastening machine for performing a screw fastening operation on a workpiece by rotation of a tool bit around its axis is provided to include a machine body, a motor, an input shaft, an output shaft, first and second clutch elements, a biasing member and a screw fastening depth regulating member. The motor is housed within the machine body. The input shaft is rotationally driven by the motor. The output shaft is disposed coaxially with the input shaft and has one longitudinal end portion to which the tool bit for screw fastening can be attached. The first clutch element rotates together with the input shaft. The second clutch element is formed in the other end portion of the output shaft and opposed to the first clutch element and serves to transmit a rotational force of the input shaft to the output shaft by engaging with the first clutch element. The biasing member applies a biasing force in such a manner as to move the first clutch element and the second clutch element away from each other so as to release engagement between the first clutch element and the second clutch element. The screw fastening depth regulating member is removably attached to the tip end region of the machine body on the one end side of the output shaft and serves to regulate a screw fastening depth by contact with the workpiece.

During a screw fastening operation which is performed by moving the machine body in a screw fastening direction while rotating the tool bit, by contact of the screw fastening depth regulating member with the workpiece, the machine body is prevented from further moving in the screw fastening direction, and in this state, by continuing the screw fastening operation, the second clutch element is moved together with the tool bit and the output shaft in the screw fastening direction by the biasing force of the biasing member. As a result, the second clutch element is moved away from the first clutch element, so that transmission of the rotating force from the input shaft to the output shaft is interrupted and the screw fastening operation is completed.

According to a preferred aspect of the present invention, the machine body has a holding part that is formed in an area other than the tip end region of the machine body and serves to removably hold the screw fastening depth regulating member removed from the tip end region. Further, the holding part is designed such that the screw fastening depth regulating member can be attached to and removed from the holding part by utilizing elastic deformation of the holding part. The "holding part" in this invention typically consists of a plurality of protrusions which are opposed to each other and can elastically deform in a direction transverse to the protruding direction. Further, the manner of "removably holding" in this invention typically represents the manner in which the holding part is engaged from radially inward or outward with an existing recessed portion, such as a hole and a groove, formed in the screw fastening depth regulating member, or it is released from such engagement. Further, the manner in which "the screw fastening depth regulating member can be attached to and removed from the holding part by utilizing elastic deformation" in this invention represents the manner in which engagement and disengagement of the screw fastening depth regulating member is effected by elastic deformation of the holding part. Further, the elastic deformation of the holding part suitably includes the manner in which the holding part deforms substantially in its entirety or in part.

According to this invention, the holding part for holding the screw fastening depth regulating member removed from the working area or the tip end region of the machine body is provided in an area other than the tip end region of the machine body. Therefore, when the screw fastening operation is performed with the screw fastening depth regulating member removed from the machine body, for example, due to operation in a tight place, the removed screw fastening depth regulating member can be held in an area other than the tip end region of the machine body. Thus, loss of the screw fastening depth regulating member can be prevented. Further, the holding part is designed such that the screw fastening depth regulating member can be attached to and removed from the holding part by utilizing elastic deformation of the holding part. Therefore, the storage region for the screw fastening depth regulating member can be rationally formed by a smaller number of parts.

Further, according to another aspect of this invention, the machine body has a grip that is formed on the side opposite to the tip end region and designed to be held by a user. The grip extends in a direction transverse to the axial direction of the tool bit and has the holding part on the extending end. According to this invention, the screw fastening depth regulating member removed from the tip end region of the machine body can be held in a position remote from the tip end region of the machine body, or the working region for a screw fastening operation by the tool bit. Further, the extending end of the grip does not interfere with a screw fastening operation. Therefore, the possibility of interference of the screw fastening depth regulating member with a screw fastening operation can be lessened.

According to this invention, an effective technique for preventing loss of a screw fastening depth regulating member removed from a machine body in a screw fastening machine is provided.

DETAILED DESCRIPTION OF THE INVENTION

Figure 1:
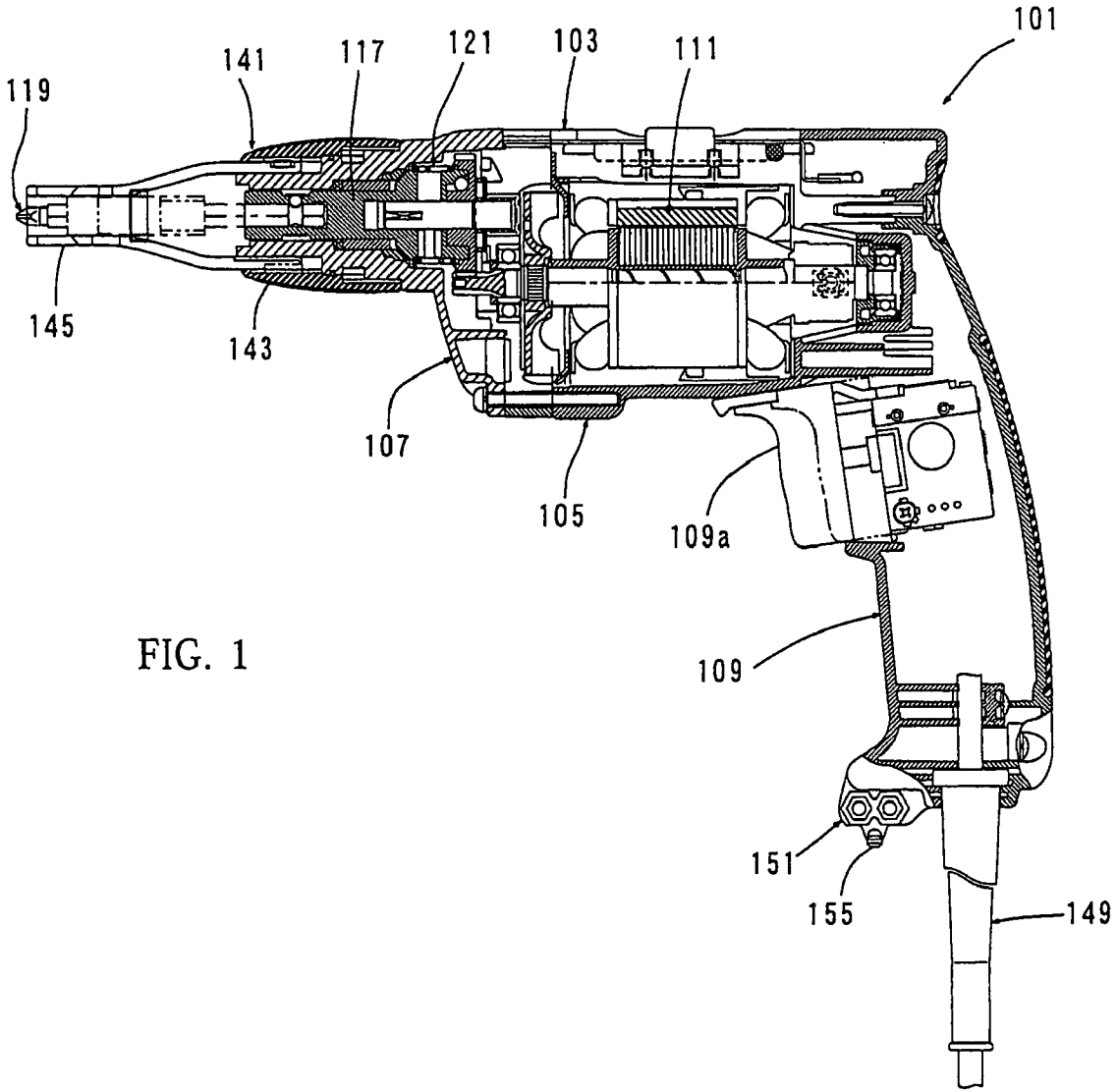
FIG. 1 is a sectional side view schematically showing an entire electric screwdriver according to an embodiment of the invention.

A representative embodiment of the present invention is now described with reference to FIGS. 1 to 5. FIG. 1 shows an entire electric screwdriver 100 as a representative embodiment of the screw fastening machine according to the present invention. The screwdriver 100 of this embodiment includes a body 103, and a driver bit 119 detachably coupled to the tip end region (on the left side as viewed in FIG. 1) of the body 103 via a spindle 117. The body 103, the spindle 117 and the driver bit 119 are features that correspond to the "machine body", the "output shaft" and the "tool bit", respectively, according to the present invention.

The body 103 includes a motor housing 105 that houses a driving motor 111, and a gear housing 107 that houses an engagement clutch 121, and a handgrip 109 designed to be held by a user and connected to the motor housing 105 on the side opposite to the driver bit 119. The engagement clutch 121 transmits the rotating output of the driving motor 111 to the spindle 117 or interrupts the transmission of the rotating output. The handgrip 109 and the driving motor 111 are features that correspond to the "grip" and the "motor", respectively, according to the present invention. An AC motor is used as the driving motor 111 in this embodiment. The driving motor 111 is driven when a trigger 109*a* on the handgrip 109 is depressed, and it stops when the trigger 109*a* is released. In the present embodiment, for the sake of convenience of explanation, the side of the driver bit 119 (the left side in FIG. 1) is taken as the front side and the side of the handgrip 109 (the right side in FIG. 1) as the rear side.

Figure 2:
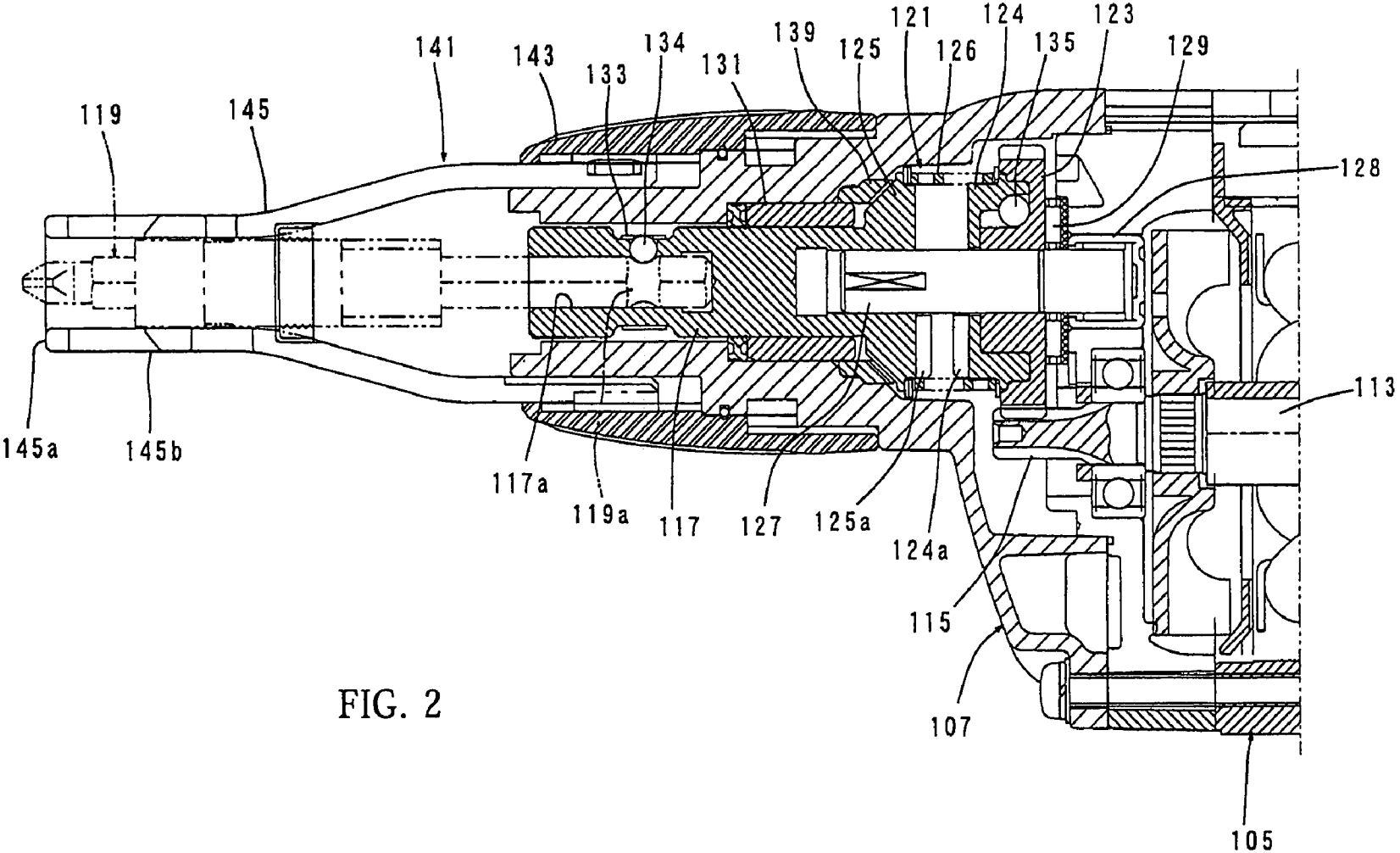
FIG. 2 is a sectional view of a driving mechanism part of a driver bit.

The construction of the engagement clutch 121 is shown in FIG. 2 in detail. The engagement clutch 121 includes a driving gear 123 that is rotationally driven by the driving motor 111, a driving-side clutch member 124 that rotates together with the driving gear 123, the spindle 117 that detachably holds the driver bit 119, and a spindle-side clutch member 125 integrally formed with the spindle 117, all of which are disposed on the same axis. The driving-side clutch member 124 and the spindle-side clutch member 125 are features that correspond to the "first clutch element" and the "second clutch element", respectively, according to the present invention. The driving-side clutch member 124 and the spindle-side clutch member 125 are opposed to each other on the same axis and have clutch teeth 124*a*, 125*a* on the respective opposing surfaces which can engage with each other.

Tightening operation is performed while applying an external force to the body 103 in the direction (screw fastening direction) in which a tip of a screw (not shown) held by the driver bit 119 is pressed against the workpiece. Under loaded conditions in which the driver bit 119 is pressed against the workpiece via the screw, the spindle-side clutch member 125 retracts toward the driving-side clutch member 124 together with the driver bit 119 and the spindle 117. As a result, the clutch teeth 125*a* of the spindle-side clutch member 125 engage with the clutch teeth 124*a* of the driving-side clutch member 124. On the other hand, under unloaded conditions in which the driver bit 119 is not pressed against the workpiece, the above-mentioned engagement is released by the biasing force of a compression coil spring 126. The compression coil spring 126 is a feature that corresponds to the "biasing member" according to this invention. FIGS. 1 and 2 show the unloaded state.

Specifically, the spindle-side clutch member 125 can move between a position in which it is engaged with the driving-side clutch member 124 by moving toward the driving-side clutch member 124 (retracting) together with the driver bit 119 and the spindle 117 and a position in which it is disengaged from the driving-side clutch member 124 by moving away from the driving-side clutch member 124 (advancing). In the following description, the clutch teeth 124*a* of the driving-side clutch member 124 and the clutch teeth 125*a* of the spindle-side clutch member 125 are referred to as driving-side clutch teeth 124*a* and driven-side clutch teeth 125*a*.

The construction of each component of the engagement clutch 121 is now described in detail. The spindle 117 is supported by the gear housing 107 via a bearing 131 such that the spindle 117 can rotate and move in the axial direction. The spindle 117 has a bit insertion hole 117*a* on its tip end portion (front end portion) and detachably holds the driver bit 119 inserted into the bit insertion hole 117*a* by engagement of a small-diameter portion 119*a* of the driver bit 119 with a plurality of steel balls 134 biased by a ring-like leaf spring 133.

A support shaft 127 is disposed in the axial center of the engagement clutch 121. One axial end (rear end) of the support shaft 127 is rotatably supported by the motor housing 105 via a bearing 128, while the other end is fitted in a bore formed in the other end portion (on the clutch member side) of the spindle 117 such that it can move in the axial direction with respect to the spindle 117 and rotate together with the spindle 117. The driving gear 123 is loosely fitted on the support shaft 127. The driving-side clutch member 124 is loosely fitted on a central cylindrical portion (boss) of the driving gear 123 and rotates together with the driving gear 123 via a plurality of (for example, three) steel balls 135. The driving gear 123 is normally held in engagement with a pinion gear 115 provided on a rotary shaft 113 of the driving motor 111. The driving gear 123 is a feature that corresponds to the "input shaft" according to this invention. A thrust bearing 129 is disposed on the rear surface side (the right side as viewed in FIG. 2) of the driving-side clutch member 124. The thrust bearing 129 serves to receive a thrust load inputted into the driving-side clutch member 124 during screw fastening operation.

The driving-side clutch member 124 and the spindle-side clutch member 125 are opposed to each other and the compression coil spring 126 is elastically disposed in a compressed state in the outer peripheral region between the opposing surfaces, or on the outer peripheral side radially outward of the driving-side clutch teeth 124*a* and the driven-side clutch teeth 125*a*. The spindle-side clutch member 125 is normally biased forward away from the driving-side clutch member 124. When the spindle-side clutch member 125 moves forward, the driven-side clutch teeth 125*a* are disengaged from the driving-side clutch teeth 124*a*. Further, the spindle-side clutch member 125 is pressed against a rubber stop ring 139 mounted on the gear housing 107 side, so that it is prevented from rotating and moving forward.

Figure 3:
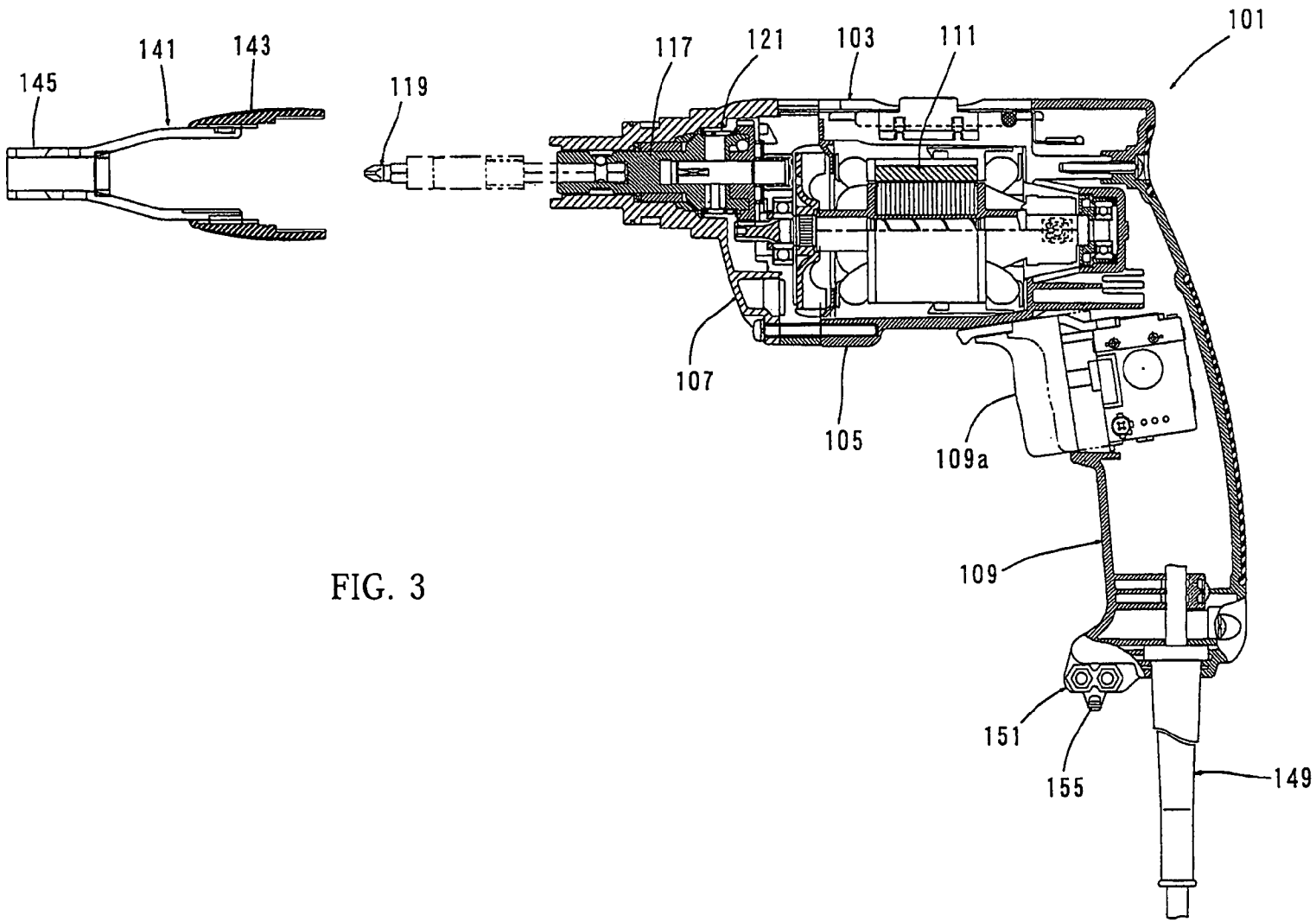
FIG. 3 is a sectional side view showing the entire electric screwdriver with a screw fastening depth regulating member removed.

A screw fastening depth regulating member 141 is removably provided in the tip end portion of the gear housing 107 and serves to regulate a screw fastening depth of a screw with respect to the workpiece during screw fastening operation. The screw fastening depth regulating member 141 is a feature that corresponds to the "screw fastening depth regulating member" according to this invention. FIGS. 1 and 2 show the screw fastening depth regulating member 141 attached to the gear housing 107 and FIG. 3 shows the screw fastening depth regulating member 141 removed from the gear housing 107. The screw fastening depth regulating member 141 mainly includes a generally cylindrical mounting sleeve 143 that is removably attached to a cylindrical portion of the gear housing 107, and an elongate cylindrical stopper sleeve 145 mounted to the front end of the mounting sleeve 143. The stopper sleeve 145 regulates the screw fastening depth by contact of its tip end (front end) or a stopper surface 145*a* with the workpiece during screw fastening operation.

The mounting sleeve 143 is removably mounted on the cylindrical portion of the gear housing 107 via a one-touch mounting and demounting mechanism (not shown). The mounting sleeve 143 mounted on the gear housing 107 is disposed generally concentrically with the spindle 117 such that the mounting sleeve 143 is allowed to rotate around its axis and prevented from moving in the axial direction. A male thread portion is provided on the outer circumferential surface of one axial end portion (rear end portion) of the stopper sleeve 145. The stopper sleeve 145 is inserted into the bore of the mounting sleeve 143 from its rear end side and threadably engaged with a female thread portion formed in the inner circumferential surface of the axial front end portion of the mounting sleeve 143. In this manner, the stopper sleeve 145 is mounted to the mounting sleeve 143. The stopper sleeve 145 surrounds the driver bit 119. The tip end of the driver bit 119 protrudes from the stopper surface 145*a* of the stopper sleeve 145. When the user rotates the mounting sleeve 143 clockwise or counterclockwise by the finger, the stopper sleeve 145 moves in the axial direction. As a result, the amount of protrusion of the driver bit 119 from the stopper surface 145*a* of the stopper sleeve 145 changes, so that the screw fastening depth is adjusted.

When a screw fastening operation reaches a final stage, the screw fastening depth regulating member 141 having the above-mentioned construction regulates the screw fastening depth with respect to the workpiece by contact of the stopper surface 145*a* of the stopper sleeve 145 with the workpiece.

Operation of the electric screwdriver 101 having the above-mentioned construction is now explained. FIG. 2 shows an unloaded state in which a screw fastening operation is not performed. In the unloaded state, the spindle-side clutch member 125 is biased away from the driving-side clutch member 124 and pressed against the stop ring 139 by the biasing force of the compression coil spring 126. Therefore, the driven-side clutch teeth 125*a* are disengaged from the driving-side clutch teeth 124*a*, so that the engagement clutch 121 is disengaged. In this state, when the driving motor 111 is driven by depressing the trigger 109*a*, the driving-side clutch member 124 and the compression coil spring 126 rotate via the pinion gear 115 and the driving gear 123. The spindle-side clutch member 125 is however held prevented from rotating by the stop ring 139 because the frictional force of the engagement surface (contact surface) of the spindle-side clutch member 125 with respect to the stop ring 139 is larger than the frictional force of the contact portion of the spindle-side clutch member 125 with respect to the compression coil spring 126. Therefore, the compression coil spring 126 rotates with respect to the spindle-side clutch member 125, and the spindle 117 is held stationary.

In such a state, when the screwdriver 101 (the body 103) is moved forward (toward the workpiece) until a screw in the driver bit 119 is pressed against the workpiece in order to perform a screw fastening operation, the body 103 moves, but the driver bit 119 and the spindle 117 do not move. Therefore, the driver bit 119 and the spindle 117 retract (to the right as viewed in FIG. 2) with respect to the body 103 while compressing the compression coil spring 126. Thus, the spindle-side clutch member 125 retracts toward the driving-side clutch member 124 and is thus disengaged from the stop ring 139. As a result, the spindle-side clutch member 125 is released from lock of the stop ring 139 against rotation and rotates following rotation of the compression coil spring 126. Such rotation is synchronized with rotation of the driving-side clutch member 124, and the driven-side clutch teeth 125*a* engage with the driving-side clutch teeth 124*a*. Thus, the spindle 117 is rotationally driven and a screw fastening operation is started.

The screwdriver 101 moves toward the workpiece as the screw fastening operation proceeds and, in the final stage of the screw fastening operation, the stopper surface 145*a* of the stopper sleeve 145 contacts the workpiece. Thereafter, the driver bit 119 and the spindle 117 move forward while continuing the screw fastening operation by the biasing force of the compression coil spring 126. Therefore, the spindle-side clutch member 125 is disengaged from the driving-side clutch member 124, so that the driven-side clutch teeth 125*a* are disengaged from the driving-side clutch teeth 124*a*. Thus, the screw fastening operation is completed.

In the screwdriver 101 having the above-mentioned construction, the screw fastening depth regulating member 141 provided in the outer peripheral region of the driver bit 119 may interfere with a screw fastening operation, for example, when the screw fastening operation is performed in a tight place. In such a case, in order to perform the screw fastening operation, the screw fastening depth regulating member 141 may be removed from the tip end region of the body 103.

Therefore, in this embodiment, in order to store the screw fastening depth regulating member 141 removed from the tip end of the gear housing 107, on the body 103, a storage region 151 is provided on the lower end of the handgrip 109 which is formed as a component of the body 103. The handgrip 109 is formed of synthetic resin and generally cylindrical. The handgrip 109 is connected to the rear end of the motor housing 105 on the side opposite to the driver bit 119, and extends from this connected area in a downward direction transverse to the axial direction of the driver bit 119. A power cord 149 is connected to the lower end or extending end of the handgrip 109 and supplies current from a power source (receptacle) in a plant or the like to the driving motor 111. The outer diameter of the power cord 149 is smaller than that of the handgrip 109. Therefore, the lateral region of the power cord 149 exists as free space. In this embodiment, this free space is utilized to provide the storage region 151 for storing the screw fastening depth regulating member 141.

Figure 4:
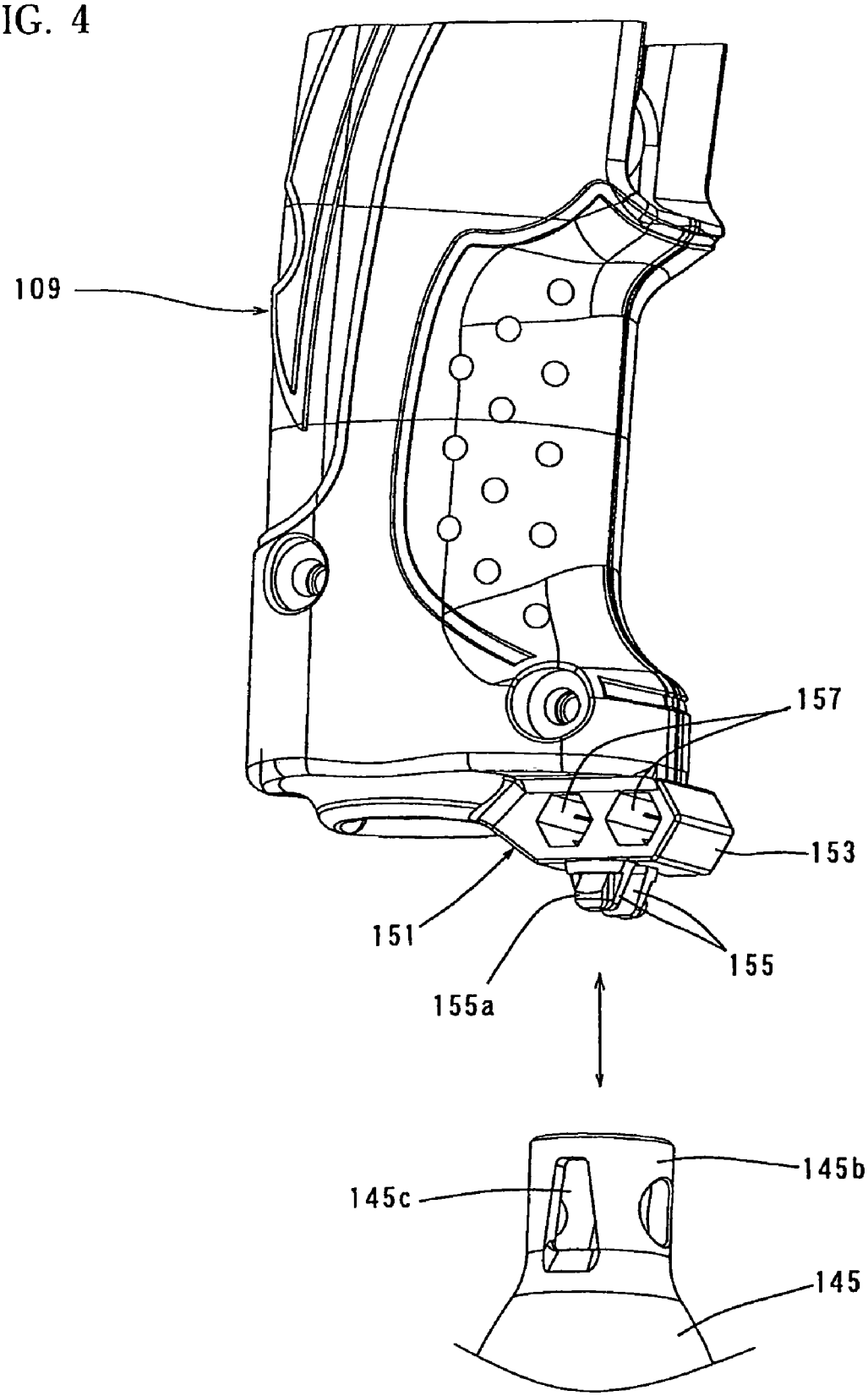
FIG. 4 is a perspective view showing a storage region for the screw fastening depth regulating member.
Figure 5:
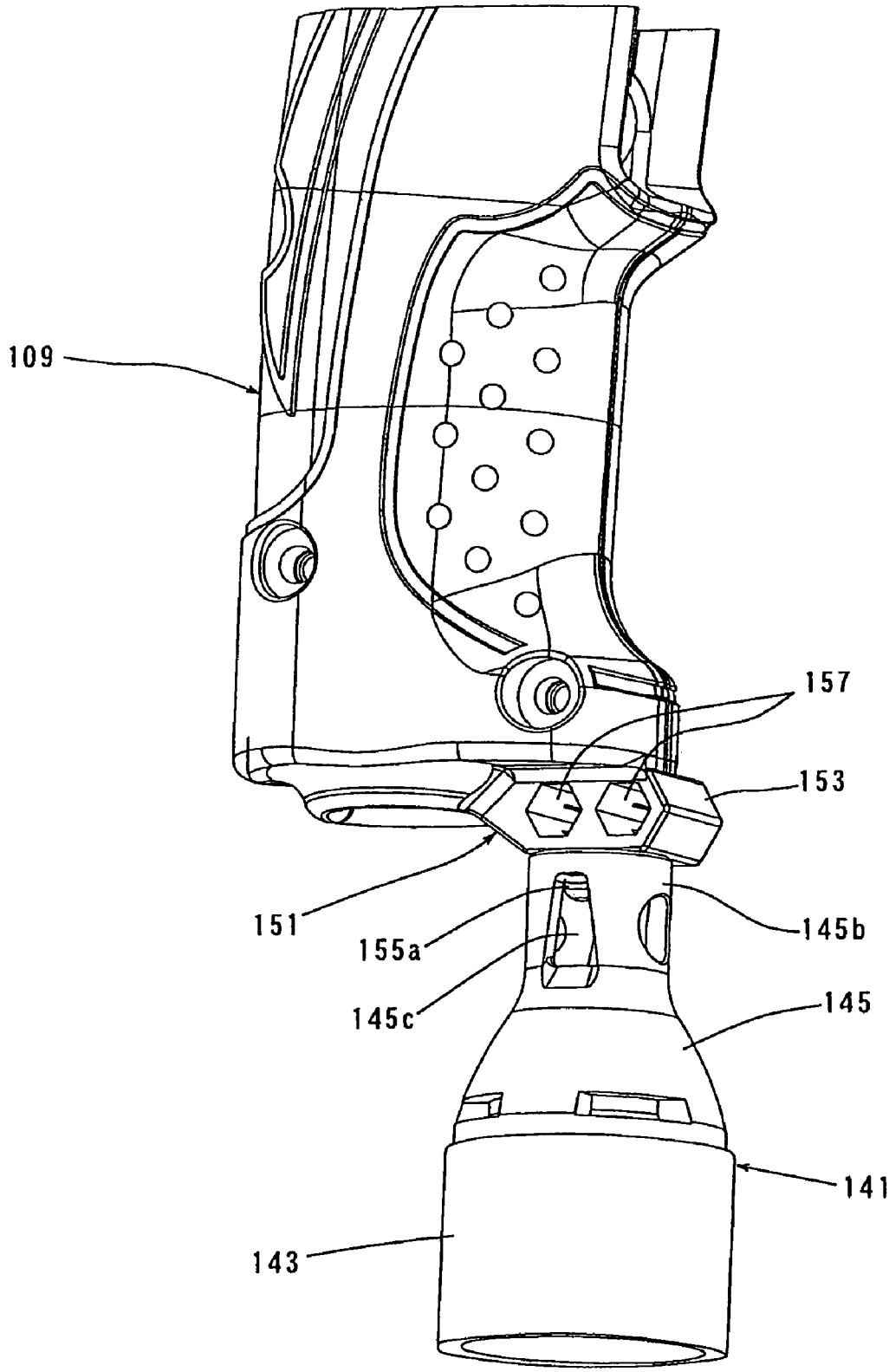
FIG. 5 is a perspective view showing the screw fastening depth regulating member stored in the storage region.
Figure 6:
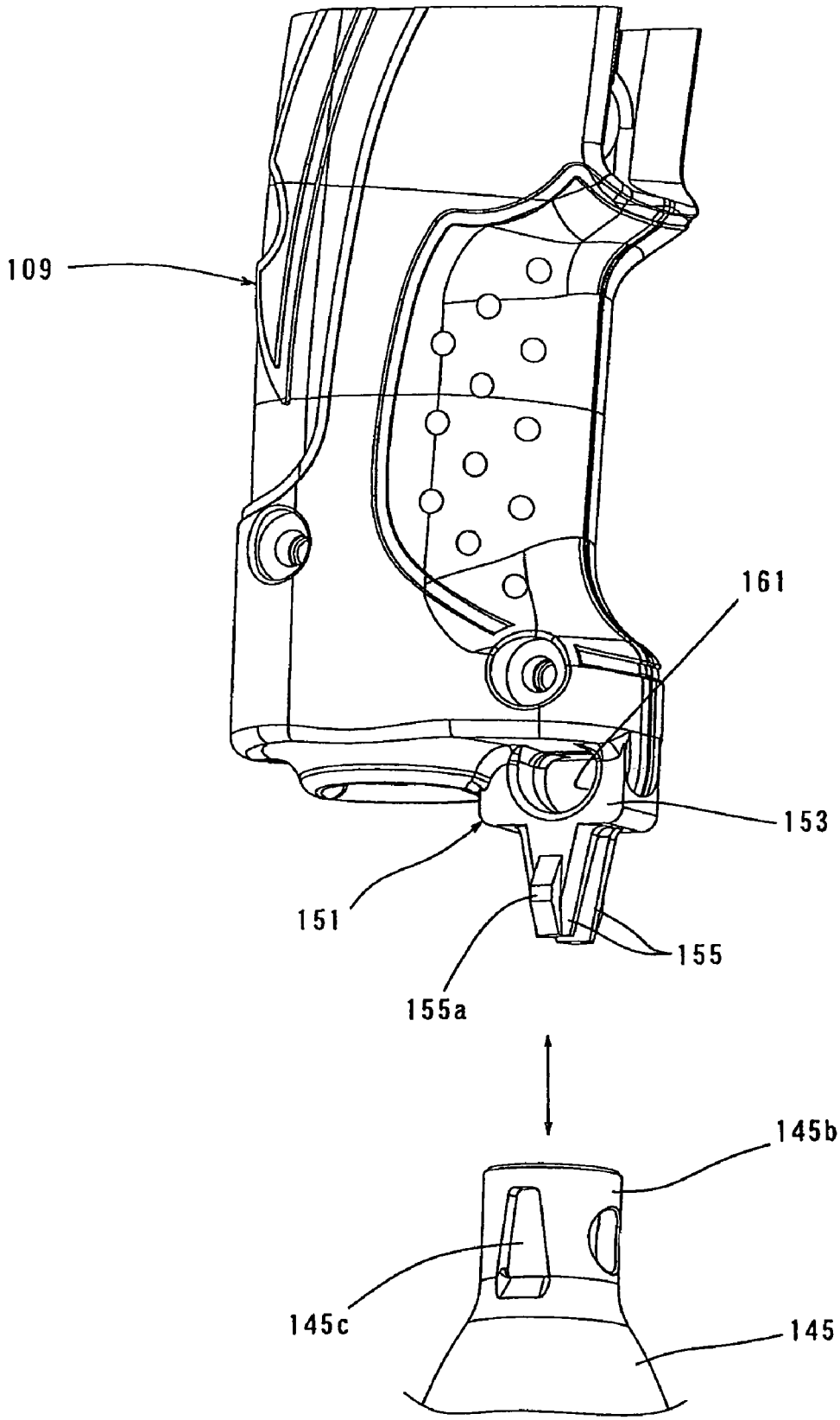
FIG. 6 is a perspective view showing a modification to the storage region.

FIG. 4 shows the storage region 151 in enlarged view, and FIG. 5 shows the screw fastening depth regulating member 141 stored and held in the storage region 151. As shown in FIG. 4, the storage region 151 mainly includes a base 153 integrally formed with the extending end of the handgrip 109, and two locking pieces 155 for sleeve holding. The locking pieces 155 protrude downward (in the extending direction of the handgrip 109) from the underside of the base 153 in parallel to each other. The two locking pieces 155 form a pair and are opposed to each other. The locking pieces 155 are features that correspond to the "holding part" according to this invention. A locking protrusion 155*a* is integrally formed on one surface (outer surface) of each of the locking pieces 155 on the side facing away from the other locking piece, and protrudes in a lateral direction transverse to the extending direction of the handgrip 109. The locking protrusion 155*a* has upper and lower tapered surfaces inclined from the base to the top. The locking pieces 155 are elastic and can elastically deform in a direction transverse to the protruding direction of the locking pieces 155 (the extending direction of the handgrip 109).

The stopper sleeve 145 of the screw fastening depth regulating member 141 is formed by an elongate cylindrical member tapered toward its tip end. The stopper sleeve 145 has a cylindrical tip end portion 145*b* on the tip end. Generally rectangular openings 145*c* are formed in the tip end portion 145*b* and arranged diametrically opposed to each other (at 180° intervals in the circumferential direction). The openings 145*c* are provided as a view port for checking the tip end of the driver bit 119. In this embodiment, the locking protrusions 155*a* of the locking pieces 155 can be engaged with the existing openings 145*c* of the stopper sleeve 145 in order to hold the screw fastening depth regulating member 141 in the storage region 151.

The screw fastening depth regulating member 141 is oriented with the mounting sleeve 143 side down and the stopper sleeve 145 side up. In this state, as shown in FIG. 4, the stopper sleeve 145 is moved upward such that the cylindrical tip end portion 145*b* of the stopper sleeve 145 is fitted over the two locking pieces 155 from below the handgrip 109. At this time, the bore edge of the tip end of the stopper sleeve 145 pushes the lower tapered surfaces of the locking protrusions 155*a*, so that the two locking pieces 155 elastically deform toward each other. Thereafter, when the locking protrusions 155*a* are aligned over the openings 145*c* of the stopper sleeve 145, the locking pieces 155 elastically return to their initial state, and the edge of each of the openings 145*c* of the stopper sleeve 145 is locked on the upper surface of the associated locking protrusion 155*a* (on the base side of the tapered surface). In this manner, as shown in FIG. 5, the screw fastening depth regulating member 141 is held in the storage region 151 in a suspended manner.

In order to remove the screw fastening depth regulating member 141 from the storage region 151, an external force is applied downward (in a direction opposite to the direction of attachment) to the screw fastening depth regulating member 141. Then the upper tapered surface of the locking protrusion 155*a* of each of the locking pieces 155 is pushed and the locking pieces 155 elastically deform toward each other. As a result, the locking protrusion 155*a* is disengaged from the edge of the associated opening 145*c*. Thus, the screw fastening depth regulating member 141 can be removed from the storage region 151 by pulling down.

According to this embodiment, the storage region 151 is provided on the lower end portion of the handgrip 109, and serves to hold the screw fastening depth regulating member 141 removed from the tip end region of the gear housing 107. Therefore, when not in use, the screw fastening depth regulating member 141 is stored and held in the storage region 151, so that the screw fastening depth regulating member 141 can be prevented from becoming lost.

Further, the lower end of the handgrip 109 is located remotest from the tip end region (working region) in the body 103, so that the handgrip 109 is hard to interfere with a fixed object existing around an area of the workpiece to be screwed in when performing a screw fastening operation while moving the body 103 in the screw fastening direction. Further, the user performs a screw fastening operation while watching the tip end of the body 103 (or the screw), so that the lower end region of the handgrip 109 is out of sight of the user during operation. Therefore, by providing the storage region 151 for the screw fastening depth regulating member 141 on the lower end of the handgrip 109, the possibility of interference of the screw fastening depth regulating member 141 with a screw fastening operation can be eliminated or lessened. Thus, the adverse effect on a screw fastening operation can be rationally avoided.

Further, in this embodiment, the screw fastening depth regulating member 141 is removably held by utilizing elastic deformation (elasticity) of the pair locking pieces 155 in a direction transverse to the protruding direction of the locking pieces 155. Therefore, the screw fastening depth regulating member 141 can be easily attached to or removed from the locking pieces 155 by linearly moving the screw fastening depth regulating member 141 in a direction in which the cylindrical tip end portion 145*b* of the stopper sleeve 145 is fitted over or pulled out of the pair opposed locking pieces 155. Further, the storage region 151 can be rationally formed by a smaller number of parts.

Further, in this embodiment, in order to hold the screw fastening depth regulating member 141, the locking protrusion 155*a* of each of the locking pieces 155 is engaged with the associated opening 145*c* of the stopper sleeve 145. In other words, the screw fastening depth regulating member 141 is held by utilizing the existing openings 145*c* formed in the stopper sleeve 145. Therefore, it is not necessary for the stopper sleeve 145 to be additionally provided with an area for engagement with the locking protrusion 155*a*. Further, the holding force of the locking protrusions 155*a* for holding the screw fastening depth regulating member 141 can be appropriately set by adjusting the bending strength of the locking pieces 155.

Further, according to this embodiment, the stopper sleeve 145 is elongate and held in the storage region 151 in a suspended manner such that the longitudinal direction of the stopper sleeve 145 coincides with the extending direction of the handgrip 109. Therefore, the stopper sleeve 145 can be prevented from protruding in a lateral direction transverse to the extending direction of the handgrip 109, so that a rational holding structure can be obtained which does not interfere with a screw fastening operation. Further, the stopper sleeve 145 is held such that the longitudinal direction of the stopper sleeve 145 coincides with the extending direction of the power cord 149. Therefore, the stopper sleeve 145 can further lessen the possibility of interfering with the screw fastening operation while avoiding interference with the power cord 149.

Further, in this embodiment, two bit holding holes 157 for holding accompanying replacement bits (not shown) are provided in the base 153 of the storage region 151. The bit holding holes 157 form the "accessory holding part" according to this invention. The bit holding holes 157 extend in a direction transverse to the protruding direction of the locking pieces 155 (transverse to the extending direction of the handgrip 109). Each of the bit holding holes 157 has a pentagonal shape corresponding to the sectional shape of the driver bit 119, and is designed such that the replacement bit is frictionally fitted into the hole 157. The manner of frictionally fitting represents the manner of holding the replacement bit by utilizing the frictional force between the inner surface of the holding hole and the outer surface of the replacement bit.

Thus, in this embodiment, the bit holding holes 157 for removably holding accompanying replacement bits other than the screw fastening depth regulating member 141 are provided in the base 153 of the storage region 151 between the extending end of the handgrip 109 and the locking pieces 155 for holding the sleeve. Therefore, the replacement bits can be stored and held without interfering with a screw fastening operation.

Next, modifications of the storage region 151 for storing the screw fastening depth regulating member 141 are explained with reference to FIGS. 6 to 11. In a modification shown in FIGS. 6 and 7, in place of the bit holding holes 157 described in the above-mentioned embodiment, a hanging hole 161 is provided in the base 153 of the storage region 151. In the other points, this modification has the same construction as the above-mentioned embodiment. The hanging hole 161 can be used to hang and store the screwdriver 101, when not in use, for example, on a nail or hook on a wall as a storage area.

Figure 7:
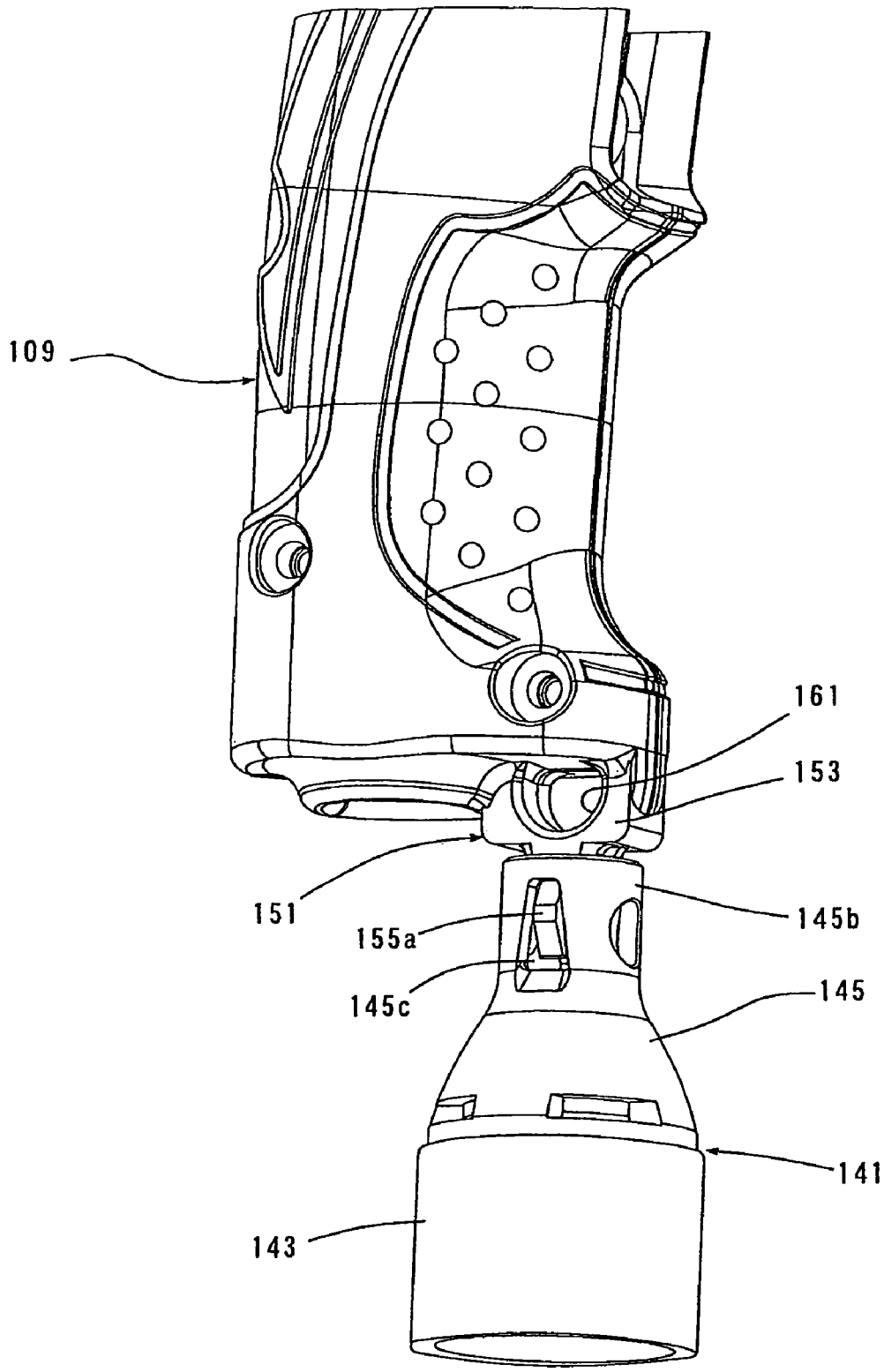
FIG. 7 is a perspective view showing the screw fastening depth regulating member stored in the storage region according to the modification shown in FIG. 6.

Further, the pair locking pieces 155 each having the locking protrusion 155*a* may be different in dimensions from those in the above-mentioned embodiment, but have the same basic construction. In other words, the locking pieces 155 are engaged with the openings 145*c* of the stopper sleeve 145 by utilizing elastic deformation of the locking pieces 155. Thus, as shown in FIG. 7, the screw fastening depth regulating member 141 can be held in the storage region 151 in a suspended manner.

Figure 8:
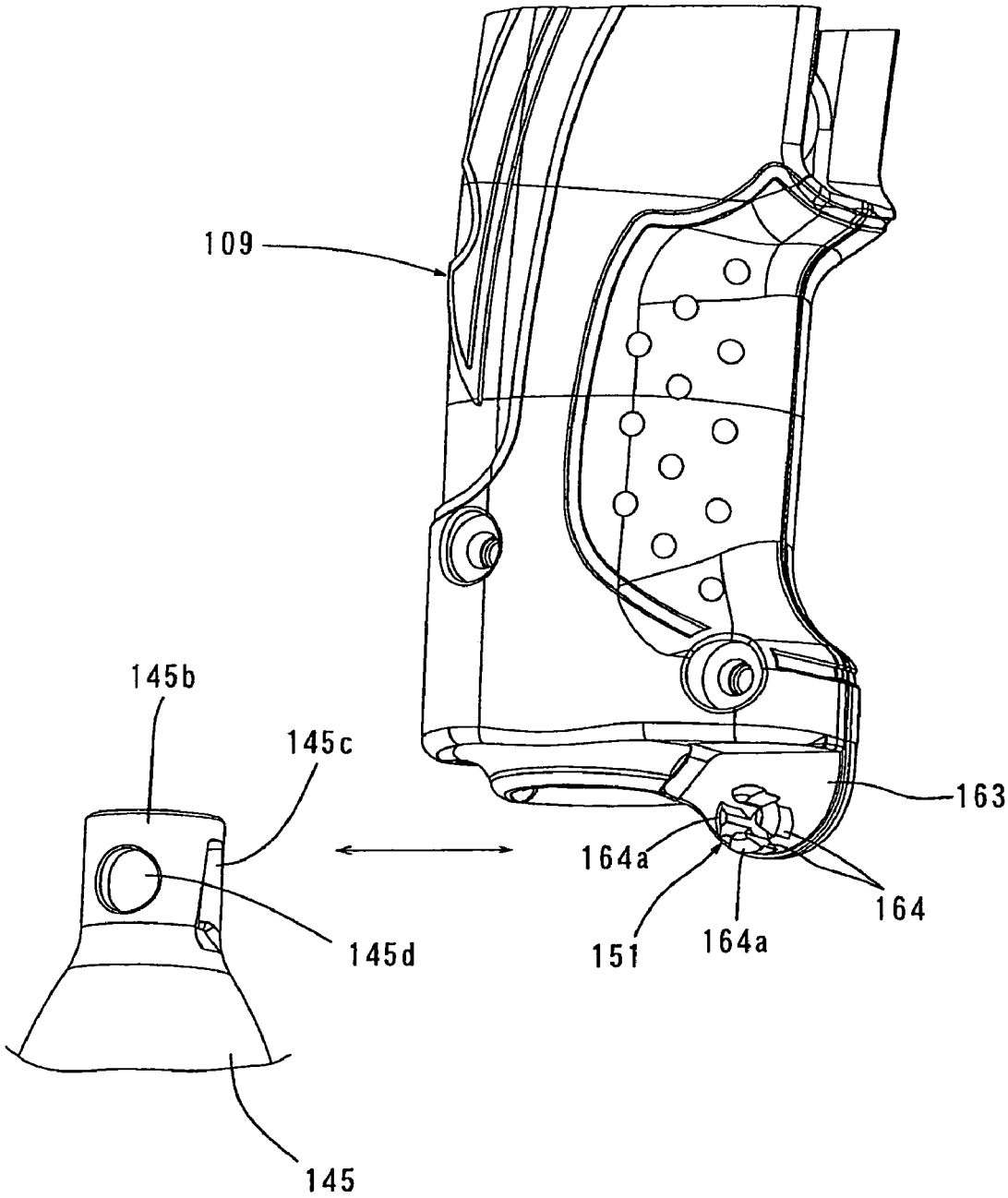
FIG. 8 is a perspective view showing another modification of the storage region.
Figure 9:
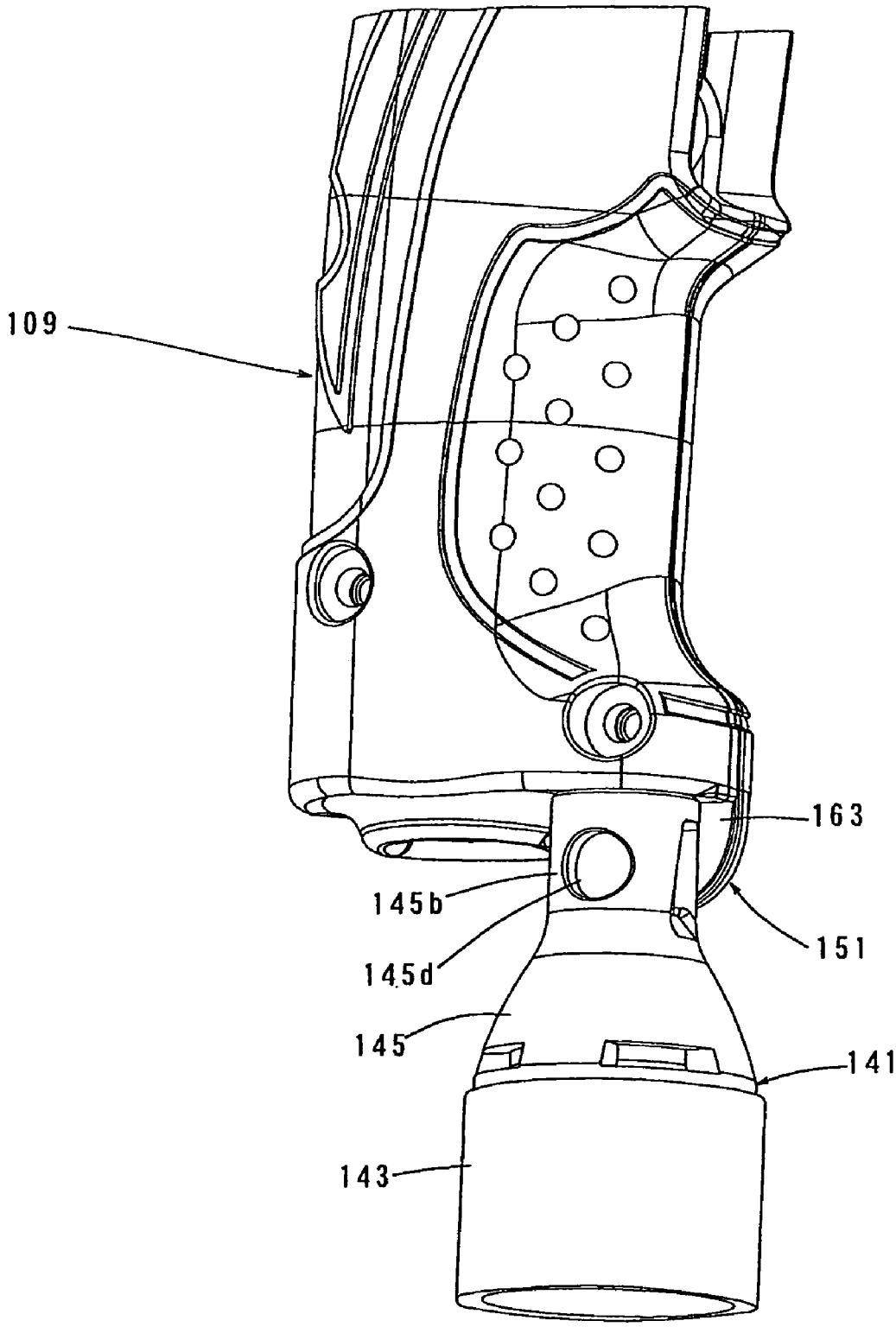
FIG. 9 is a perspective view showing the screw fastening depth regulating member stored in the storage region according to the modification shown in FIG. 8.

Now, a modification shown in FIGS. 8 and 9 is explained. The storage region 151 according to this modification includes an oblong base 163 protruding downward from the lower end or extending end of the handgrip 109. A plurality of (four in this modification) locking pieces 164 are integrally formed on the side surface of the base 163 and protrude horizontally in a direction transverse to the protruding direction of the base 163. The locking pieces 164 are arranged at predetermined intervals in the circumferential direction in such a manner as to form a circular shape as a whole. A radially protruding locking protrusion 164*a* is integrally formed on the outer surface of each of the locking pieces 164. The locking pieces 164 can elastically deform in a radial direction transverse to the protruding direction of the locking pieces 164. The locking pieces 164 are features that correspond to the "holding part" according to this invention.

In this modification, as shown in FIG. 8, the screw fastening depth regulating member 141 can be attached to and removed from the locking pieces 164 by moving the screw fastening depth regulating member 141 in a radial direction transverse to its longitudinal direction. The stopper sleeve 145 has two circular through holes 145*d* formed radially through the cylindrical tip end portion 145*b* and arranged between the openings 145*c* at 180° intervals in the circumferential direction. The screw fastening depth regulating member 141 can be attached to the storage region 151 by inserting the horizontally protruding locking pieces 164 of the base 163 into either of the two circular through holes 145*d*, and it can be removed from the storage region 151 by pulling the locking pieces 164 out of the circular through hole 145*d*.

When the locking pieces 164 are inserted into the circular through hole 145*d* of the stopper sleeve 145 or when the locking pieces 164 are pulled out of the circular through hole 145*d*, the locking protrusions 164*a* are pushed by the inner wall surface of the circular through hole 145*d* and the locking pieces 164 elastically deform radially inward. As a result, the screw fastening depth regulating member 141 is allowed to be attached to or removed from the locking pieces 164. Further, in order to facilitate elastic deformation of the locking pieces 164 during attachment and removal of the screw fastening depth regulating member 141, each of the locking protrusions 164*a* has a tapered surface inclined from the base to the top. Further, when the locking pieces 164 are inserted into the circular through hole 145*d*, the locking protrusions 164*a* are engaged with the edge of the circular through hole 145*d*. Thus, the screw fastening depth regulating member 141 is held in the storage region 151 in a suspended manner (see FIG. 9).

Thus, according to this modification, like in the above-mentioned embodiment, the screw fastening depth regulating member 141 can be attached and removed by utilizing elastic deformation of the locking pieces 164. Therefore, the storage region 151 can be rationally formed by a smaller number of parts.

Figure 10:
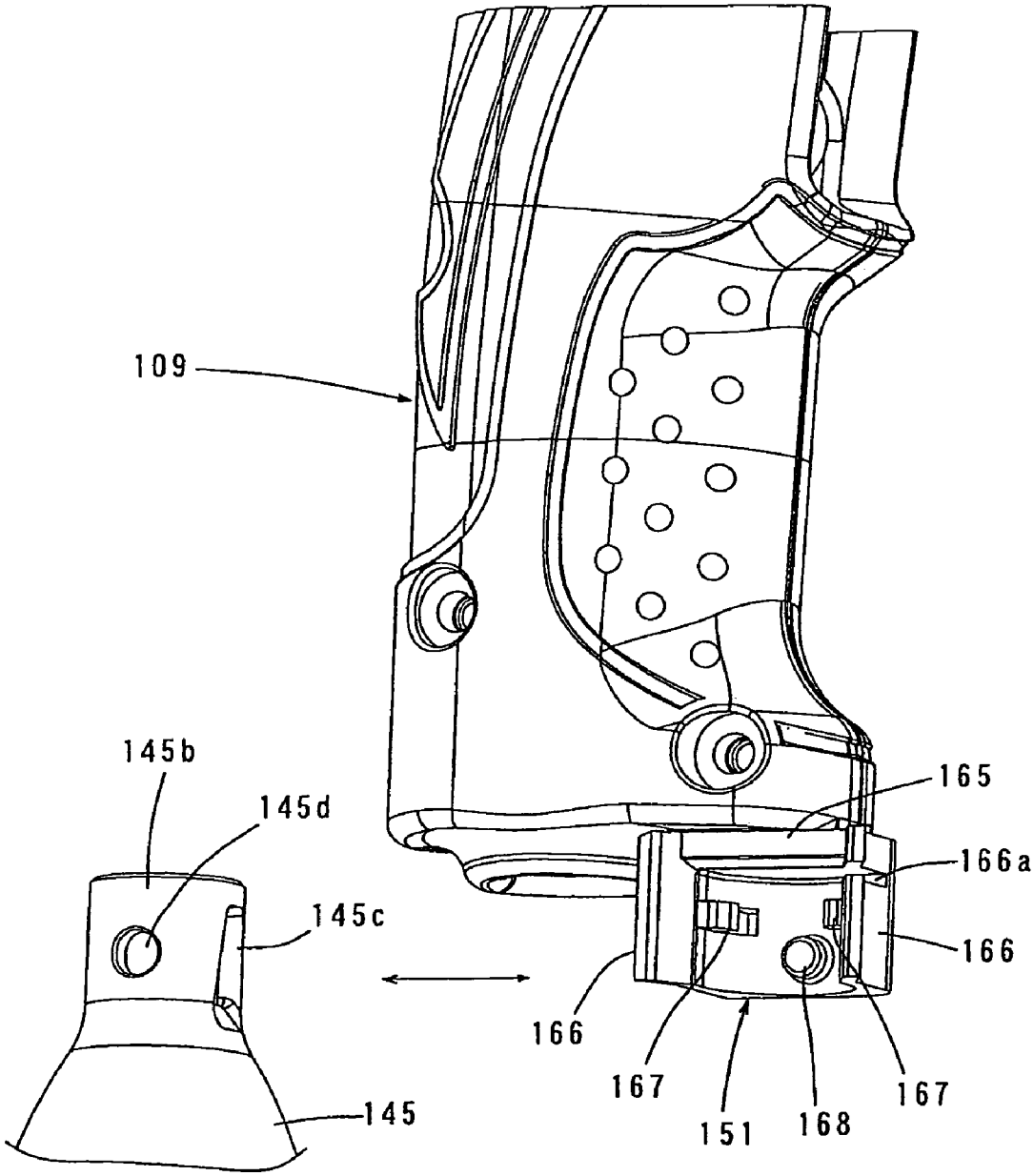
FIG. 10 is a perspective view showing a further modification of the storage region.
Figure 11:
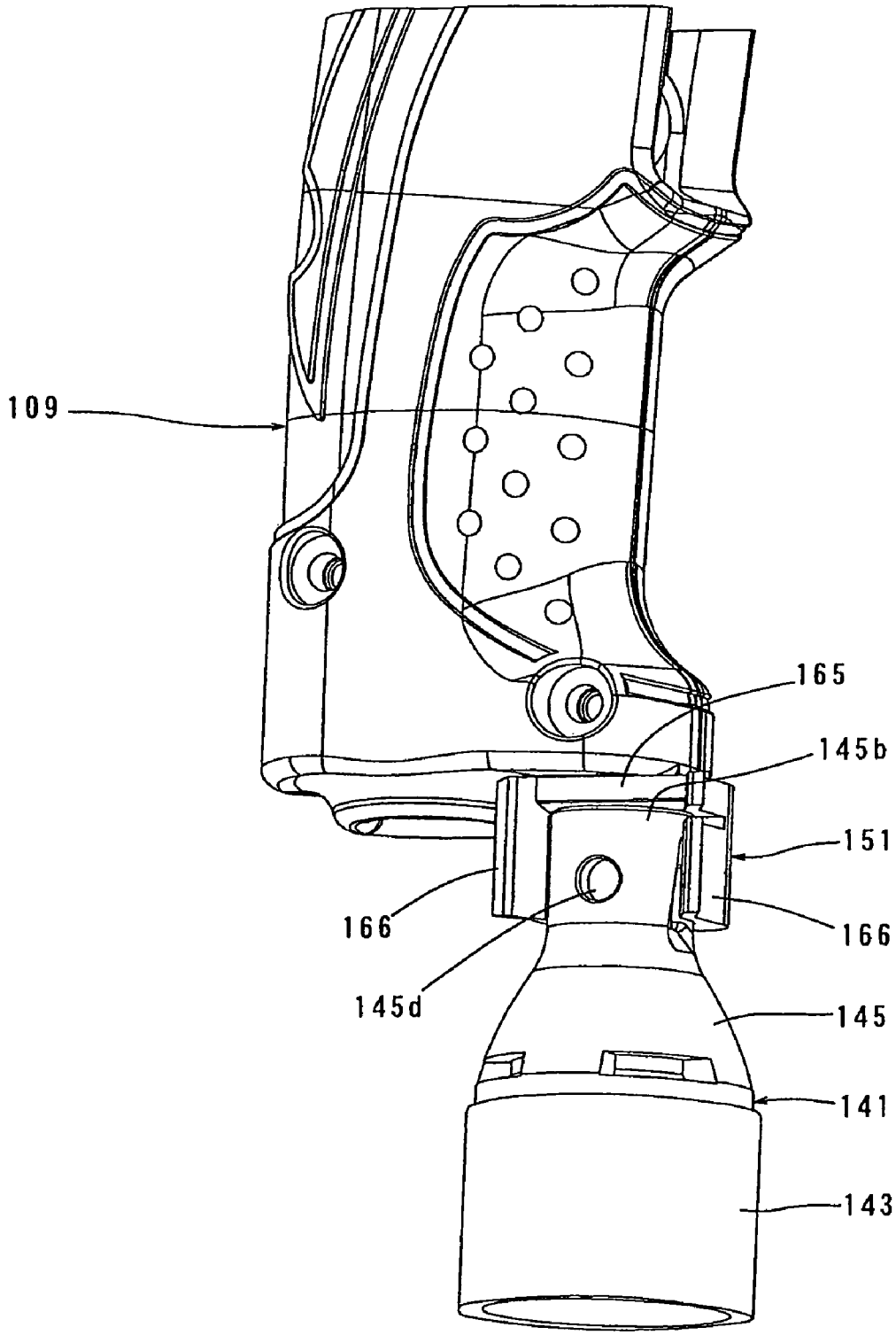
FIG. 11 is a perspective view showing the screw fastening depth regulating member stored in the storage region according to the modification shown in FIG. 10.

Now, another modification shown in FIGS. 10 and 11 is explained. The storage region 151 according to this modification includes a horizontal base 165 integrally formed on the lower end or extending end of the handgrip 109, and a holding frame 166 integrally connected to the underside of the base 165 and generally U-shaped as viewed from below. Two locking pieces 167 are formed on the inner surface of the holding frame 166 and opposed to each other in the circumferential direction, and a circular protrusion 168 is formed between the two locking pieces 167. Further, a region of the holding frame 166 in which at least one of the locking pieces 167 is formed has a slit 166*a* in the area of connection with the base 165 such that it can elastically deform radially (in a horizontal direction). The holding frame 166 is a feature that corresponds to the "holding part" according to this invention.

In the above-described modification shown in FIGS. 10 and 11, the screw fastening depth regulating member 141 can be attached to and removed from the storage region 151 by moving the screw fastening depth regulating member 141 in a radial direction transverse to its longitudinal direction as shown in FIG. 10. Specifically, by moving the cylindrical tip end portion 145*b* of the stopper sleeve 145 into the holding frame 166, the two locking pieces 167 receive a force applied in a direction in which the locking pieces 167 are pushed outward by the outer surface of the cylindrical tip end portion of the stopper sleeve 145. Thus, the holding frame 166 having the slit 166*a* elastically deforms, so that the cylindrical tip end portion 145*b* is allowed to enter the holding frame 166. Thereafter, when the locking pieces 167 are aligned with the openings 145*c* which are formed in the cylindrical tip end portion 145*b* of the stopper sleeve 145 and arranged at 180° intervals in the circumferential direction of the cylindrical tip end portion 145*b*, the holding frame 166 elastically returns to its original state and the locking pieces 167 are engaged with the associated openings 145*c*. At the same time, the circular protrusion 168 is fitted into either of the circular through holes 145*d* each formed between the two openings 145*c* of the cylindrical tip end portion 145*b*. Thus, the screw fastening depth regulating member 141 can be held in the storage region 151 in a suspended manner (see FIG. 11). The screw fastening depth regulating member 141 can be removed by pulling out of the holding frame 166.

Thus, according to this modification, like in the above-mentioned embodiment, the screw fastening depth regulating member 141 can be attached and removed by utilizing elastic deformation of the holding frame 166 having the locking pieces 167. Therefore, the storage region 151 can be rationally formed by a smaller number of parts.

DESCRIPTION OF NUMERALS

100 electric screwdriver (screw fastening machine)
103 body (machine body)
105 motor housing
107 gear housing
109 handgrip (grip)
109*a* trigger
111 driving motor (motor)
113 rotary shaft
115 pinion gear
117 spindle (output shat)
117*a* bit insertion hole
119 driver bit (tool bit)
119*a* small-diameter portion
121 engagement clutch
123 driving gear (input shaft)
124 driving-side clutch member (first clutch element)
124*a* driving-side clutch teeth
125 spindle-side clutch member (second clutch element)
125*a* driven-side clutch teeth
126 compression coil spring (biasing member)
127 support shaft
128 bearing
129 thrust bearing
131 bearing
133 leaf spring
134 steel ball
135 steel ball
139 stop ring
141 screw fastening depth regulating member
143 mounting sleeve
145 stopper sleeve
145*a* stopper surface
145*b* cylindrical tip end portion
145*c* opening
145*d* circular through hole
149 power cord
151 storage region
153 base
155 locking piece (holding part)
155*a* locking protrusion
157 bit holding hole (accessory holding part)
161 hanging hole (accessory holding part)
163 base
164 locking piece (holding part)
164*a* locking protrusion
165 base
166 holding frame (holding part)
166*a* slit
167 locking piece
168 protrusion

We claim:

1. A screw fastening machine for performing a screw fastening operation on a workpiece by rotation of a tool bit around its axis, comprising:

a machine body, a motor housed within the machine body, an input shaft which is rotationally driven by the motor, an output shaft disposed coaxially with the input shaft and having one longitudinal end portion to which the tool bit for screw fastening can be attached, a first clutch element that rotates together with the input shaft, a second clutch element that is formed in the other end portion of the output shaft and opposed to the first clutch element and that serves to transmit a rotational force of the input shaft to the output shaft by engaging with the first clutch element, a biasing member that applies a biasing force in such a manner as to move the first clutch element and the second clutch element away from each other so as to release engagement between the first clutch element and the second clutch element, and a screw fastening depth regulating member that is removably attached to the tip end region of the machine body on the one end side of the output shaft to regulate a screw fastening depth by contact with the workpiece, the screw fastening depth regulating member including at least one circumferential opening on a tip end portion, wherein:

during a screw fastening operation which is performed by moving the machine body in a screw fastening direction while rotating the tool bit, upon contact of the screw fastening depth regulating member with the workpiece, the machine body is prevented from further moving in the screw fastening direction, and in this state, by continuing the screw fastening operation, the second clutch element is moved together with the tool bit and the output shaft in the screw fastening direction by the biasing force of the biasing member, whereby the second clutch element is moved away from the first clutch element, so that transmission of the rotating force from the input shaft to the output shaft is interrupted and the screw fastening operation is completed, the machine body has a holding part that is formed on a bottom side of a handgrip that is distal from the tip end region of the machine body to removably hold the screw fastening depth regulating member removed from the tip end region, the holding part including one or more locking protrusion that is configured to engage within the at least one circumferential opening provided on the tip end portion of the screw fastening depth regulating member and the screw fastening depth regulating member is held by means of the at least one circumferential opening, and the holding part is provided such that the screw fastening depth regulating member can be attached to and removed from the holding part by utilizing elastic deformation of the holding part.

2. The screw fastening machine as defined in claim 1, wherein the grip is formed on the side opposite to the tip end region and designed to be held by a user, and the grip extends in a direction transverse to the axial direction of the tool bit and has the holding part on the extending end.

3. The screw fastening machine as defined in claim 2, wherein the screw fastening depth regulating member is elongate and held in the holding part such that its longitudinal direction coincides with the extending direction of the grip.

4. The screw fastening machine as defined in claim 2, wherein the grip has a power cord that supplies an AC current to the motor, and the extending direction of the power cord and the longitudinal direction of the screw fastening depth regulating member substantially coincide with the extending direction of the grip.

5. The screw fastening machine as defined in claim 2, further comprising an accessory holding part for removably holding an accessory other than the screw fastening depth regulating member, wherein the accessory holding part is provided between the extending end of the grip and the holding part for the screw fastening depth regulating member.

6. The screw fastening machine as defined in claim 2, wherein a hanging hole is provided between the extending end of the grip and the holding part for the screw fastening depth regulating member.

7. The screw fastening machine as defined in claim 1, wherein the at least one circumferential opening is configured to allow a user to check the tip end of the tool bit.

8. The screw fastening machine as defined in claim 1, wherein the screw fastening depth regulating member is attached and removed from the holding part in direction that crosses the longitudinal axis of the screw fastening depth regulating member.

* * * * *